US008225905B2

(12) United States Patent
Delaittre et al.

(10) Patent No.: US 8,225,905 B2
(45) Date of Patent: Jul. 24, 2012

(54) ASCENDER DEVICE WITH CAM FOR BELAYING ON A FIXED ROPE

(75) Inventors: Arnaud Delaittre, La Rochette (FR); Alain Maurice, Saint Hilaire du Touvet (FR); Paul Petzl, Barraux (FR)

(73) Assignee: Zedel, Crolles (FR)

( * ) Notice: Subject to any disclaimer, the term of this patent is extended or adjusted under 35 U.S.C. 154(b) by 362 days.

(21) Appl. No.: 12/591,116

(22) Filed: Nov. 9, 2009

(65) Prior Publication Data

US 2010/0126802 A1 May 27, 2010

(30) Foreign Application Priority Data

Nov. 27, 2008 (FR) ..... 08 06664

(51) Int. Cl.
*A62B 1/12* (2006.01)

(52) U.S. Cl. ..... 182/192; 182/190; 182/191; 182/193

(58) Field of Classification Search ..... 182/12, 182/17, 192, 193, 109, 191
See application file for complete search history.

(56) References Cited

U.S. PATENT DOCUMENTS

| | | | | | |
|---|---|---|---|---|---|
| 3,811,155 | A | * | 5/1974 | Stafford | 24/115 G |
| 4,034,828 | A | | 7/1977 | Rose et al. | |
| 4,253,218 | A | | 3/1981 | Gibbs | |
| 4,542,884 | A | * | 9/1985 | Dodge, Jr. | 254/391 |
| 4,560,029 | A | * | 12/1985 | Dalmaso | 182/5 |
| 4,657,110 | A | * | 4/1987 | Wolner | 182/5 |
| 4,669,582 | A | * | 6/1987 | Sandreid | 188/65.1 |
| 4,846,075 | A | * | 7/1989 | Tupper | 104/209 |
| 4,912,817 | A | * | 4/1990 | Sandreid | 24/132 R |
| 5,083,350 | A | * | 1/1992 | Sandreid | 24/134 R |
| 5,146,655 | A | * | 9/1992 | Gibbs | 24/134 R |
| 5,156,240 | A | | 10/1992 | Ostrobrod | |
| 5,265,696 | A | * | 11/1993 | Casebolt | 182/8 |
| 5,638,919 | A | | 6/1997 | Pejout | |
| 5,855,251 | A | * | 1/1999 | Deuer | 182/5 |
| 5,924,522 | A | * | 7/1999 | Ostrobrod | 182/191 |
| 6,009,977 | A | * | 1/2000 | Pelofi | 182/192 |
| 6,019,195 | A | * | 2/2000 | Pelofi | 182/192 |
| 6,056,086 | A | * | 5/2000 | Gortan et al. | 182/197 |
| 6,945,357 | B1 | * | 9/2005 | Flux | 182/36 |
| 7,845,467 | B2 | * | 12/2010 | Petzl et al. | 182/5 |

FOREIGN PATENT DOCUMENTS

| | | |
|---|---|---|
| EP | 0 678 310 A1 | 10/1995 |
| FR | 2 311 213 | 12/1976 |
| FR | 2 568 132 A1 | 1/1986 |

* cited by examiner

*Primary Examiner* — Alvin C. Chin-Shue
*Assistant Examiner* — Colleen M Chavchavadze
(74) *Attorney, Agent, or Firm* — Oliff & Berridge, PLC

(57) ABSTRACT

An ascender device for belaying on a fixed rope, comprising a body with a trough, and an actuating lever having a pivot, a cam for clamping the rope, and a hole for attaching a safety means. A connecting arm with a button-hole is articulated between the pivot and body to move the actuating lever between an inactive position facilitating insertion of the rope in the trough and an active position wherein the ends of the pivot are housed in aligned recesses acting as bearings. A double lock comprises a first lock and a second lock to secure the two opposite ends of the pivot in the recesses, each lock being associated with an unlocking tab for releasing same.

6 Claims, 6 Drawing Sheets

ASCENDER DEVICE WITH CAM FOR BELAYING ON A FIXED ROPE

BACKGROUND OF THE INVENTION

The invention relates to an ascender device for belaying on a fixed rope comprising a body with a trough for the rope to pass through, and an actuating lever having a pivot, a cam for clamping the rope, and a hole for attaching a safety means.

Such an ascender is designed for secured progression on a fixed rope and for constituting hauling or hoisting systems.

STATE OF THE ART

An ascender known under the trade-name Microcender from PETZL (registered trademark) comprises a U-shaped clamp forming a trough, a lever with a locking cam, and a removable pin enabling the ascender to be fitted or removed at any point of the rope. The lever and pin remain connected to the body of the ascender via a flexible link to make them captive after the pin has been removed.

The document EP 678310 relates to a fall arrest device able to be automatically locked onto a safety rope. It comprises:

a body with a trough for passage of the rope, an actuating lever having a pivot, a cam for clamping the rope, and a hole for attaching a safety means, a connecting part arranged between the pivot and body to move the actuating lever between an inactive position wherein the rope can be inserted the trough and an active position wherein the ends of the pivot are housed in aligned recesses of the body acting as bearings, a lock to secure the pivot in the recesses in said active position or to allow the latter to escape when moving to the inactive position of said actuating lever.

Such an apparatus is complicated to achieve as the free end of the connecting part that does not bear the cam is mounted rotating around a sliding spindle which is elastically loaded in the direction opposite to that of the recesses.

The document U.S. Pat. No. 4,034,828 also mentions an ascender device with a cam means, equipped with a lock to secure the pivot in two opposite recesses of the body. Connection of the actuating lever with the body of the ascender is performed by a flexible chain making the latter captive after the pivot has been released.

OBJECT OF THE INVENTION

The object of the invention consists in providing an ascender device with a cam that is easy to handle and is able to be fitted quickly on a fixed belaying rope, and in improving safety.

The ascender device according to the invention is characterized in that the lock is double comprising a first lock and a second lock to hold the two opposite ends of the pivot in the recesses, each lock being associated with an unlocking tab to unlock the latter.

The presence of the double lock and of the connecting arm enables the pivot to be removed and inserted quickly in the recesses. Fitting the rope in the trough is thus made easier in the inactive position, and the pivot being secured by the double lock guarantees safety in the active position.

According to a preferred embodiment, the connecting part is formed by an articulated arm and the first lock is mounted pivoting on a first pin which passes through a button-hole of the connecting arm. A second lock is mounted pivoting on a second pin on the opposite side of the trough. The connecting arm extends in a plane parallel to the actuating lever and operates in combination with a stop in the proximity of the hole. Each lock is provided with an unlocking tab designed to make it pivot to a released position against the return force of the torsion springs.

According to another feature of the invention, the body is equipped with a slot for insertion of the connecting arm when movement takes place between the active and inactive positions, said slot being located next to the trough.

The connecting part can naturally be replaced by any other equivalent connection.

BRIEF DESCRIPTION OF THE DRAWINGS

Other advantages and features will become more clearly apparent from the following description of two embodiments of the invention given for non-restrictive example purposes only and represented in the appended drawings, in which.

DETAILED DESCRIPTION OF THE INVENTION

Figure 1:
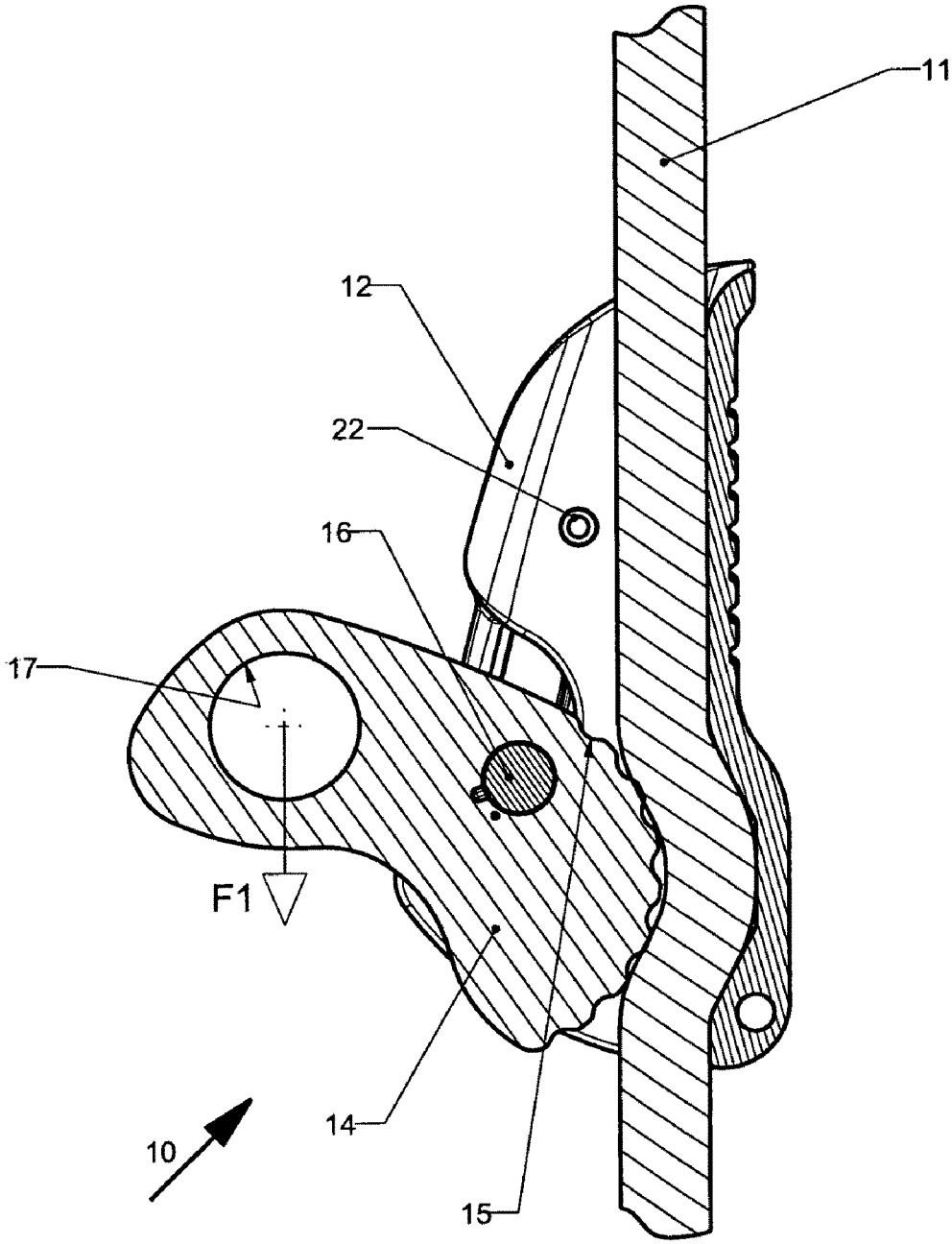
FIG. 1 is a vertical cross-sectional view of the ascender device with the actuating lever represented in the active position blocking the rope.
Figure 2:
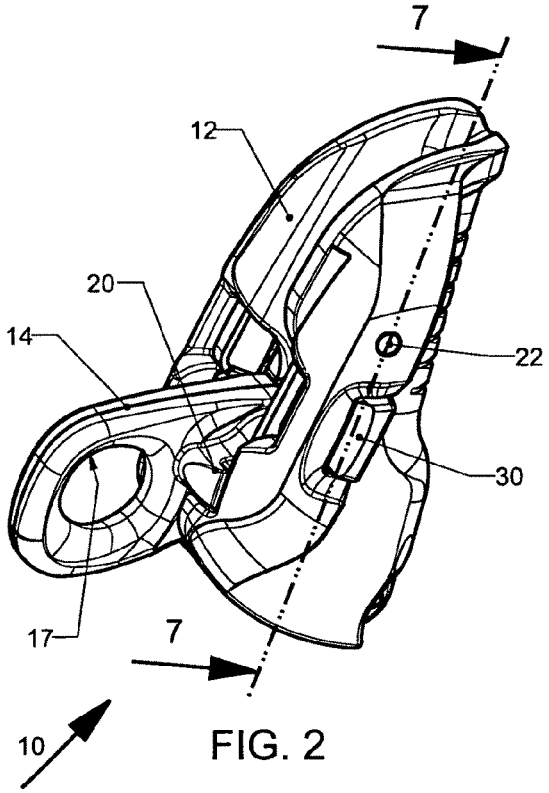
FIGS. 2 to 4 show perspective views of the ascender device of FIG. 1 from different angles.
Figure 3:
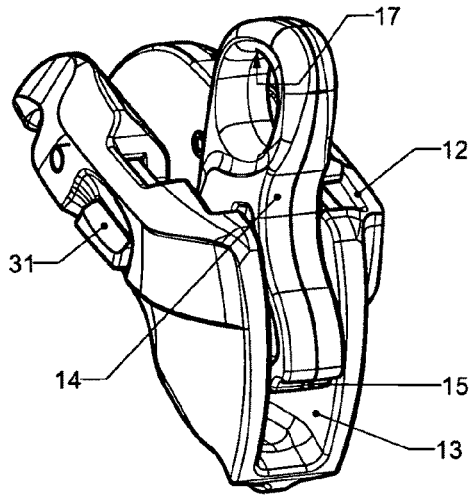
Figure 4:
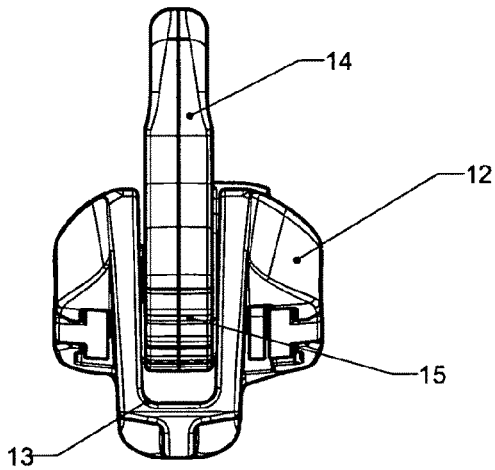

With reference to FIGS. 1 to 9, an ascender device 10 is used in climbing for belaying a climber along a fixed rope 11. It comprises a metal body 12 provided with a central trough 13 for passage of the rope 11, and an actuating lever 14 with a locking cam 15.

Figure 9:
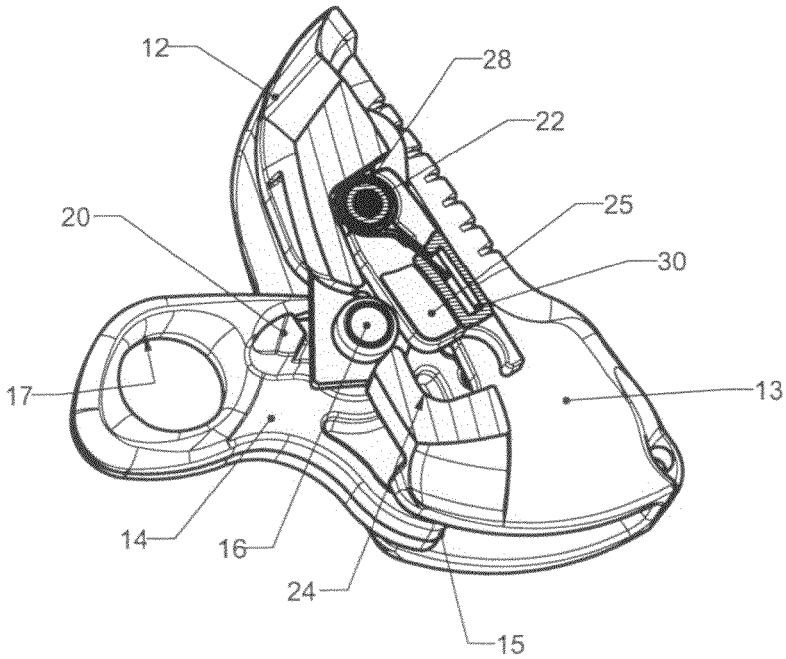

Actuating lever 14 can swivel around a transverse pivot 16 between a first clamping position (FIGS. 1 and 8) and a second releasing position of rope 11 (FIG. 9). Cam 15 extends up to the inside end of actuating lever 14 facing the bottom of trough 13 so as to clamp rope 11 in the first position. At the opposite end of cam 15, actuating lever 14 is provided with a circular hole 17 accessible from the outside for attaching a safety means designed to be connected to the climber's harness.

The safety means can be a carabiner, a cord or a strap. The surface of cam 15 coming into contact with rope 11 comprises a plurality of ribs or raised dots.

After rope 11 has been inserted in trough 13, ascender device 10 allows the climber to slide upwards freely and has a blocking effect in the downwards direction. A return spring 18 (FIG. 7), formed for example by a torsion spring, is arranged coaxially around pivot 16 to bias actuating lever 14 in the direction of trough 13.

A connecting part EL, formed for example by a rigid arm 19 connected to body 12 and operating in conjunction with a stop 20 in proximity to hole 17 of actuating lever 14, is articulated on pivot 16. Arm 19 of connecting part EL extends in a plane parallel to actuating lever 14 with a lateral offset and is provided with an oblong button-hole 21 through which a first fixed pin 22 securedly affixed to body 12 passes.

Body 12 is equipped with a slot 23 for connecting arm 19 to pass through, said slot being situated on the same side as trough 13 and parallel to the latter. The inside of body 12 also comprises a pair of recesses 24 aligned in the transverse direction to act as bearings for pivot 16 of actuating lever 14.

Two locks 25, 26 are pivotally mounted on each side of trough 13 respectively on first pin 22 and on a second pin 27 to secure the opposite ends of pivot 16 in recesses 24. The two pins 22, 27 are aligned and independent from one another. Each lock 25, 26 is biased to the securing position by a torsion spring 28, 29. An unlocking tab 30, 31 is provided to make each lock 25, 26 pivot to a position releasing pivot 19, against the return force of the corresponding springs 28, 29.

Actuating lever 14 with its pivot 16 and cam 15 is thus movable between an active position and an inactive position by means of connecting arm 19 articulated on body 12.

Figure 5:
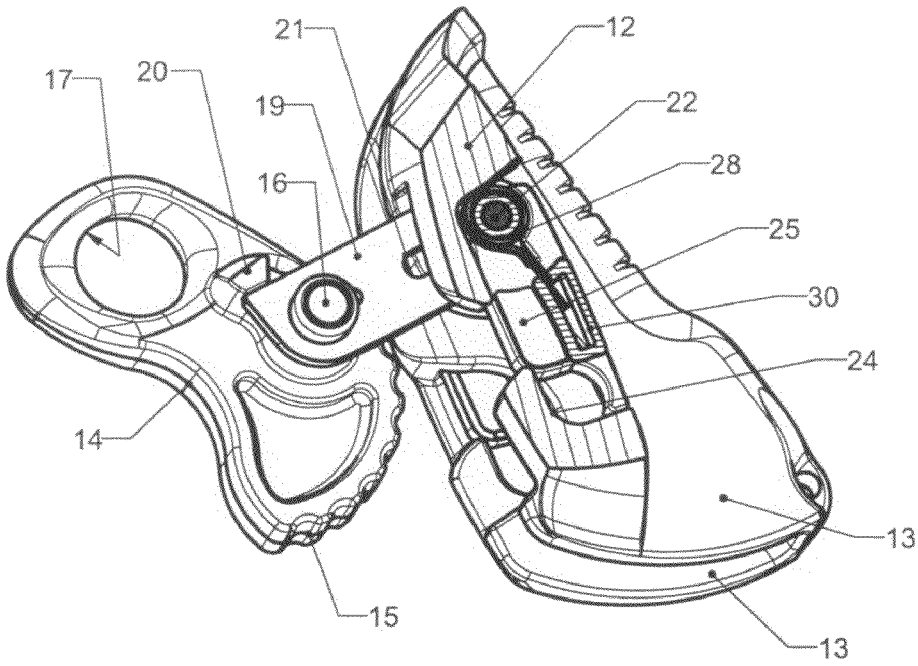
FIG. 5 represents a perspective view in partial cross-section of the body of the ascender device with the actuating lever occupying the inactive position after the pivot has escaped from its bearings.

The inactive position is illustrated in FIG. 5, actuating lever 14 being separated from trough 13 by the maximum distance and remaining attached to body 12 by connecting arm 19 which can nevertheless swivel freely around first pin 22. Insertion of rope 11 in trough 13 is thereby made easier when button-hole 21 of connecting arm 19 is at end of travel on first pin 22. Installation of ascender device 10 on rope 11 is thus possible at any time.

Figure 6:
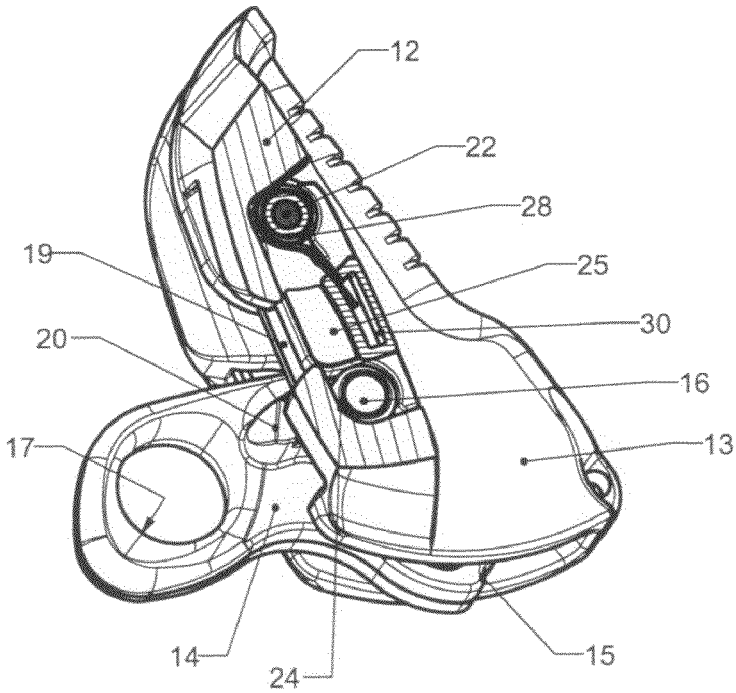
FIG. 6 is an identical view to FIG. 5 with the actuating lever occupying the active position after the pivot has been inserted in the bearings.
Figure 7:
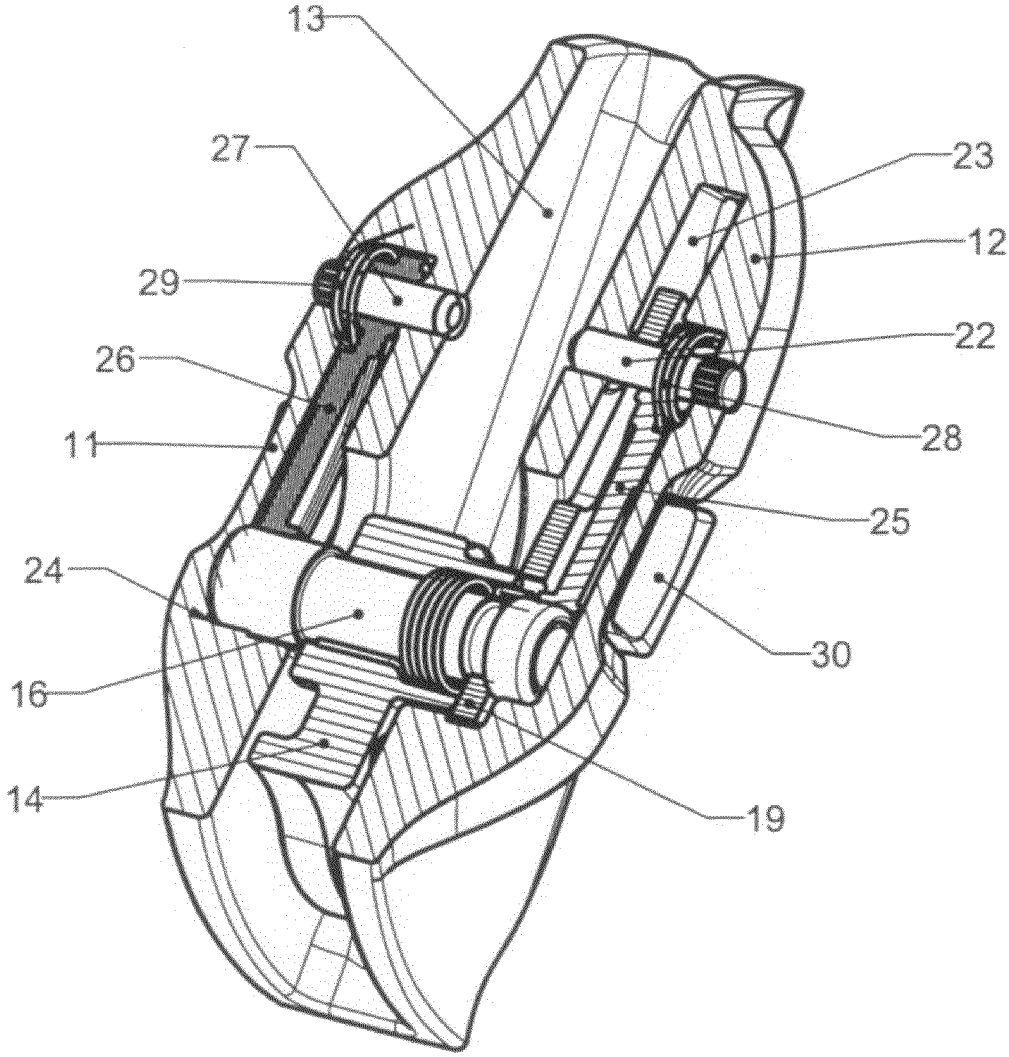
FIG. 7 shows a transverse cross-sectional view of the ascender device of FIG. 2 along the line 7-7.
Figure 8:
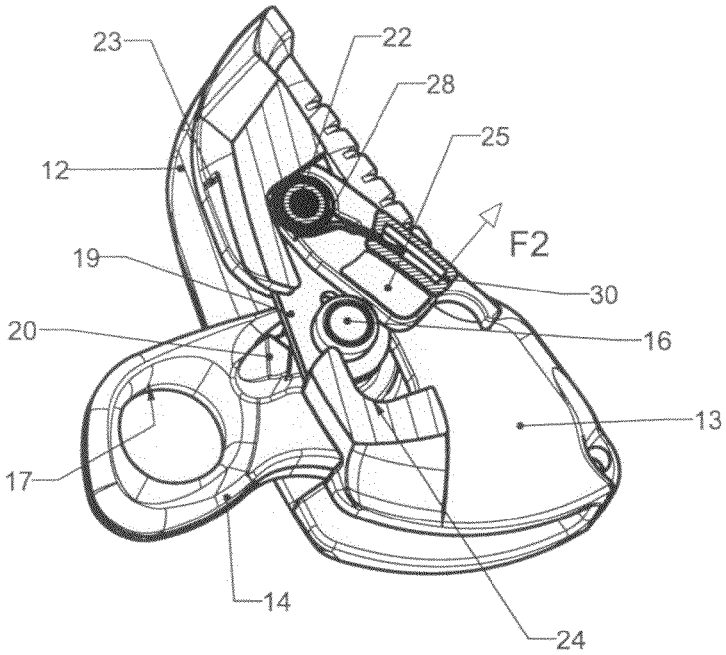
FIGS. 8 and 9 represent identical views to FIG. 6 when the pivot of the actuating lever moves to the active position.

The active position is represented in FIG. 6 in which pivot 16 is housed in recesses 24 and kept in place by the two locks 25, 26 which are in the securing position due to the action of their respective return springs 28, 29. Cam 15 can then occupy either the clamping position (FIG. 1) when a force F1 is applied to the end of actuating lever 14 (in the event of the climber falling) or the second released position allowing ascender device 10 to slide freely along rope 11 when the climber pulls it upwards.

Movement from the active position to the inactive position takes place after locks 25, 26 have been previously unlocked to the released position (see arrow F2 in FIG. 8), followed by a lifting movement of actuating lever 14 allowing pivot 16 to escape. The latter leaves recesses 24 acting as bearings and releases actuating lever 14 which nevertheless remains attached to body 12 by connecting arm 19 (FIGS. 9 and 5).

Movement in the reverse direction from the inactive position to the active position is achieved by pushing actuating lever 14 in the direction of trough 13. The reaction of the ends of pivot 16 on locks 25, 26 makes the latter withdraw to the released position and enables pivot 16 to be fitted in recesses 24. Pivot 16 is then centred and held in its bearings by automatic returning of locks 25, 26 to the securing position.

Figure 10:
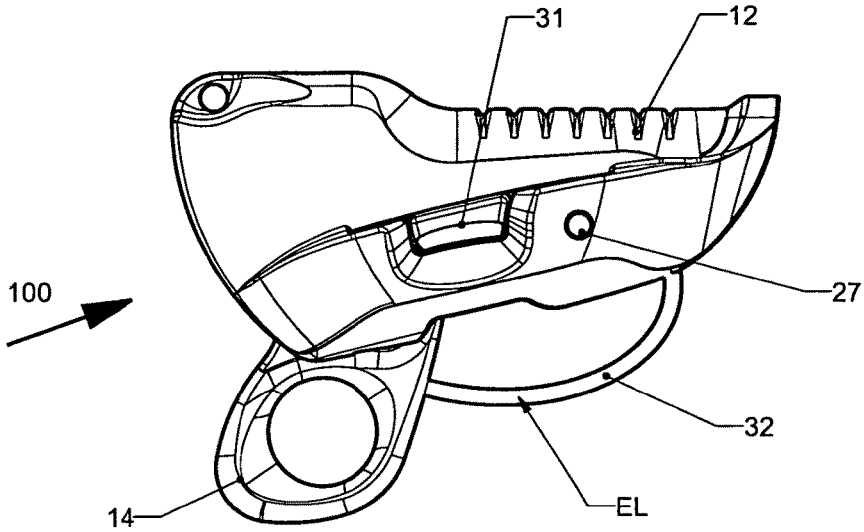
FIGS. 10 and 11 are perspective views of an alternative embodiment respectively in the active position and in the inactive position.
Figure 11:
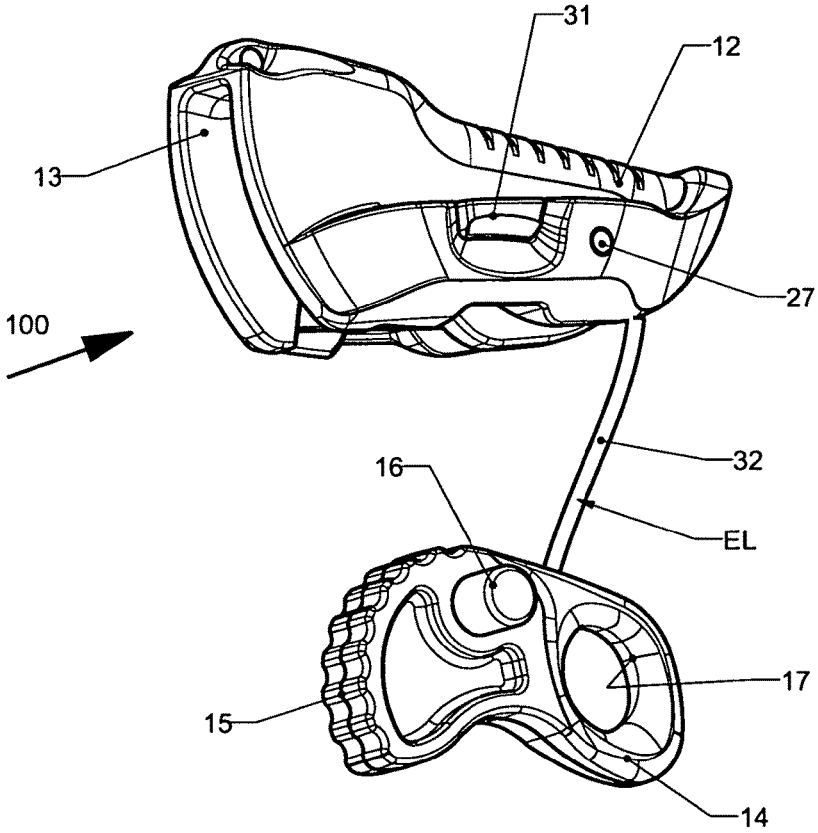

According to the alternative embodiment of FIGS. 10 and 11, connecting part EL of ascender device 100 is formed by a cable 32 fixed to actuating lever 14 and to body 12. Cable 32 acts both as captive link and as return means of actuating lever 14 to the inactive position after unlocking tabs 31 of the locks have been previously released.

The invention claimed is:

1. An ascender device for belaying on a fixed rope, comprising:

a body with a trough for the rope to pass through, an actuating lever having a pivot, a cam for clamping the rope, and a hole for attaching a safety means, a connecting part arranged between the pivot and the body to move the actuating lever between an inactive position in which the rope is inserted in the trough and an active position in which the ends of the pivot are housed in aligned recesses of the body acting as bearings, a lock to perform securing of the pivot in the recesses in said active position or to allow it to escape when moving to the inactive position of said actuating lever, wherein the lock is a double lock comprising a first lock and a second lock to secure the two opposite ends of the pivot in the recesses, each lock being associated with an unlocking tab to unlock the latter, the connecting part is formed by a rigid connecting arm articulated on the pivot and body, and the first lock is mounted pivoting on a first pin that passes through a button-hole of the connecting arm.

2. The ascender device according to claim 1, wherein the second lock is mounted pivoting on a second pin which is aligned in the parallel direction with the first pin.

3. The ascender device according to claim 1, wherein a torsion spring is associated with each lock to bias the latter to a position securing the pivot, and the trough is located between the two locks.

4. The ascender device according to claim 1, wherein the connecting arm extends in a plane parallel to the actuating lever and operates in conjunction with a stop in proximity to the hole.

5. The ascender device according to claim 4, wherein the body is equipped with a slot for insertion of the connecting arm when moving between the active and inactive positions, said slot being situated parallel to the trough.

6. The ascender device according to claim 1, wherein the connecting part is formed by a cable.

* * * * *